US005282221A

United States Patent [19]

Benedict et al.

[11] Patent Number: 5,282,221

[45] Date of Patent: Jan. 25, 1994

[54] HIGH TEMPERATURE HEATING ELEMENT STANDOFF

[75] Inventors: James R. Benedict, North Berwick, Me.; Carl H. Mamigonian, Dover, N.H.

[73] Assignee: Rolock, Inc., Fairfield, Conn.

[21] Appl. No.: 985,612

[22] Filed: Dec. 3, 1992

[51] Int. Cl.[5] ..... F27D 1/00

[52] U.S. Cl. ..... 373/128; 219/542; 174/138 J

[58] Field of Search ..... 373/128-131, 373/112; 219/536, 542, 402; 338/315, 316; 432/225; 174/138 J, 138 E, 138 G

[56] References Cited

U.S. PATENT DOCUMENTS

| | | |
|---|---|---|
| 3,134,836 | 5/1964 | Malinowski . |
| 3,812,276 | 5/1974 | Cyrway, Jr. et al. . |
| 4,259,538 | 3/1981 | Jones . |
| 4,321,415 | 3/1982 | Christian et al. . |
| 4,429,403 | 1/1984 | Hooper . |
| 4,771,166 | 9/1988 | McGuire et al. . |
| 4,799,881 | 1/1989 | Grier et al. . |

FOREIGN PATENT DOCUMENTS

| | | | |
|---|---|---|---|
| 102465 | 3/1984 | European Pat. Off. . | |
| 295299 | 8/1928 | United Kingdom | 373/128 |
| 743935 | 1/1956 | United Kingdom | 373/128 |

OTHER PUBLICATIONS

"VFS Receives Vacuum Furnace Heating Element Patent," Mar. 31, 1981, William R. Jones, President.

Horizontal Vacuum Furnaces, G-M Enterprises, 20325 E. Walnut Dr., City of Industry, Calif. 91789.

*Primary Examiner*—Bruce A. Reynolds
*Assistant Examiner*—John A. Jeffery
*Attorney, Agent, or Firm*—Ware, Fressola Van Der Sluys & Adolphson

[57] ABSTRACT

A ceramic high temperature vacuum furnace heating element standoff 10 is provided to hold a portion of an electrical high temperature heating element 62 inside the hot zone of a vacuum furnace. The standoff 10 comprises a heating element holder 18 and an anchoring rod 16. The heating element holder 18 is designed as a single ceramic piece constructed to retain the vacuum furnace heating element. The anchoring rod 16 has a straight end 50 and a hooked end 52. The straight end 50 is inserted into a neck 34 of the heating element holder 18 where the rod is retained by a pin 60. The standoff 10 is held to the vacuum furnace wall 58 by engagement of the hooked end 52 with a transverse pin 86 in a pipe-like member 82 welded to the vacuum furnace wall 58.

6 Claims, 3 Drawing Sheets

FIG. 3
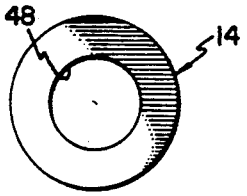
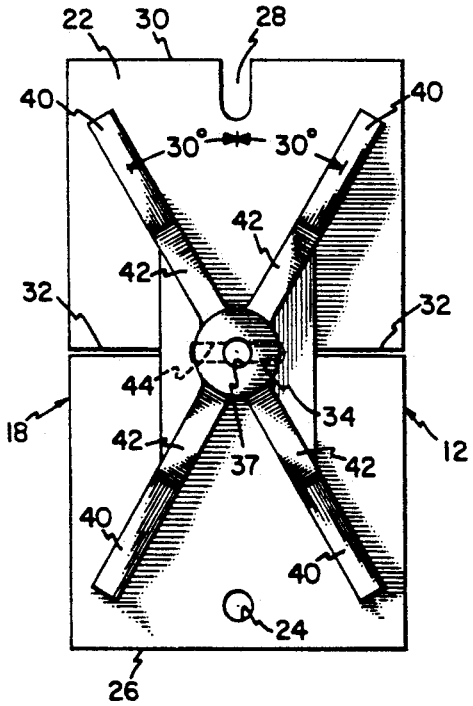
FIG. 2
FIG. 1
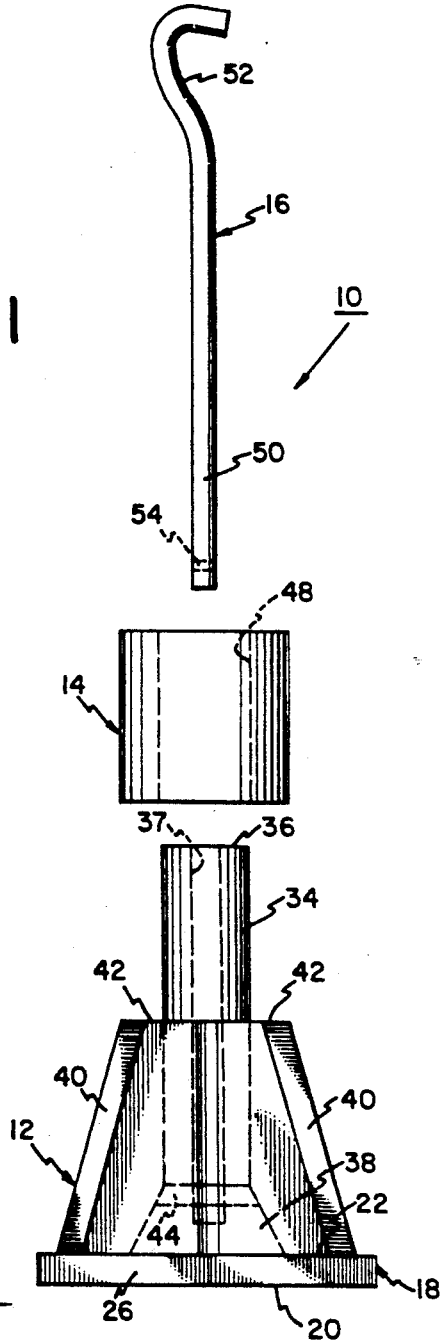

FIG. 6
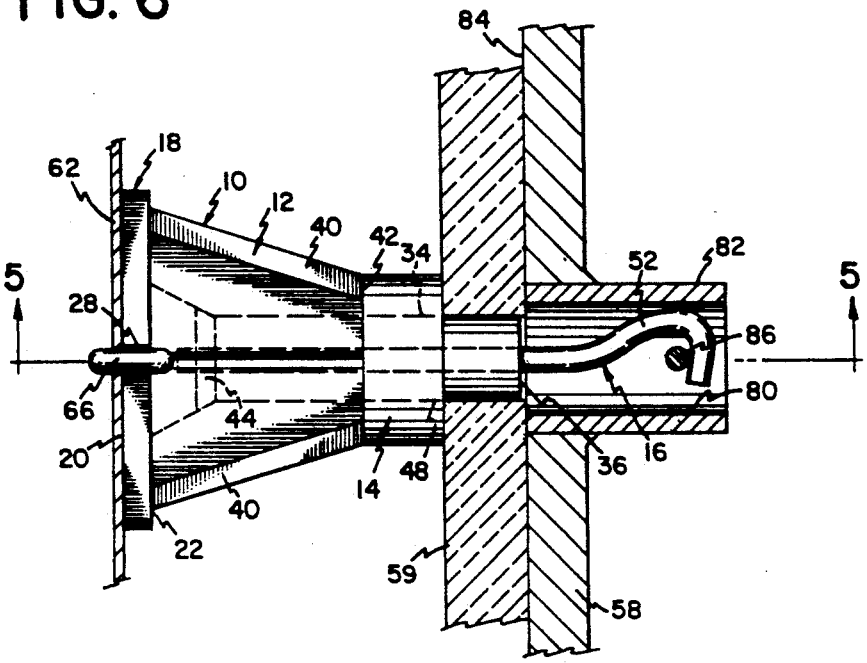
FIG. 4
FIG. 5
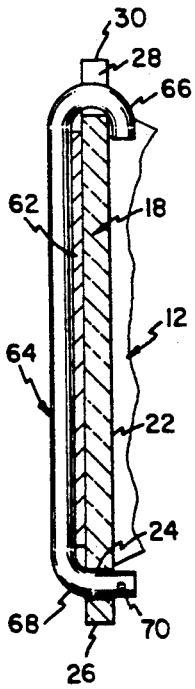
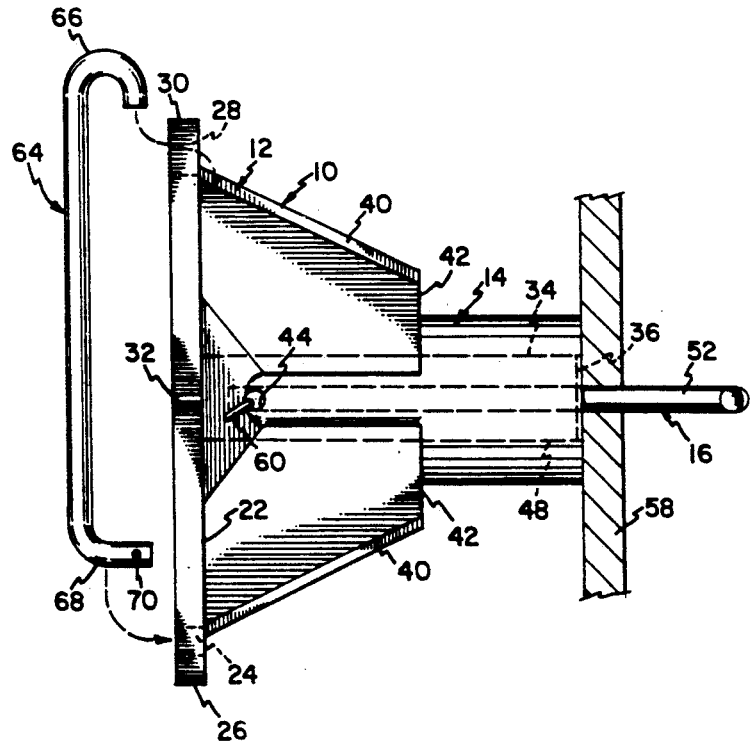

HIGH TEMPERATURE HEATING ELEMENT STANDOFF

FIELD OF THE INVENTION

The present invention relates to vacuum heat treating furnaces. More particularly, the present invention relates to a high temperature heating element standoff assembly for supporting high temperature flat electrical resistance heating elements used in heat treating vacuum furnaces.

DESCRIPTION OF THE PRIOR ART

High temperature vacuum heat treating furnaces and the like often employ a plurality of flat-shaped or ribbon electrical resistance heating elements. The flat-shaped heating elements are usually arranged inside an area of the furnace referred to as the "hot zone." The flat heating elements are typically held in place by a plurality of heating element standoffs. Such heating element standoffs must withstand the high temperatures found in the hot zone and must provide a high degree of electrical insulation from the furnace walls. Because typical vacuum furnace operation involves numerous heating and cooling cycles, the component parts of the furnace, including the heating element standoffs, undergo tremendous expansion and contraction. These expansions and contractions appear to introduce serious deformation and embrittlement difficulties particularly with standoffs fabricated from molybdenum.

Some examples of arrangements for vacuum furnace heating element standoffs may be found in U.S. Pat. Nos. 4,321,415, 4,429,403, and 4,771,166. The arrangements shown in the above referenced examples typically employ molybdenum bodies having short spans of ceramic insulators to provide a high degree of electrical insulation at high temperatures. The use of such short spans is disadvantageous because the spans tend to accumulate metallic coatings during heat cycles. The accumulation of metallic coatings lowers the electrical resistance of the short ceramic insulative spans over a period of time and when the electrical resistance becomes low enough, short circuits develop and heating element burnout results.

Other disadvantages of the prior art standoffs include the use of small molybdenum wires to attach the heating element to the standoff and the use of numerous parts. In the event that a heating elements must be replaced, the use of such small molybdenum wires tends to make the replacement of elements a time-consuming and tedious task. The use of numerous parts make such standoffs expensive to manufacture.

The present invention provides an improved heating element standoff by using substantially entirely ceramic material between the heating element and furnace wall to provide a standoff with a durable high electrical resistance in a harsh vacuum furnace environment. The sophisticated design of the heating element standoff permits easy installation of the standoff and the heating element in the furnace.

SUMMARY OF THE INVENTION

The present invention relates to a heating element standoff for a vacuum heat treating furnace. The basic components of the heating element standoff of the present invention comprise a ceramic heating element holder and an anchoring rod.

The ceramic heating element holder includes a heating element support platform having a first surface and a second surface that define the thickness of the platform. The support platform has a notch and an aperture both extending through the thickness of the platform, for anchoring a heating element retaining clip. The support platform also has a first slit and second slit extending through the thickness. Each slit extends inward from an edge of the platform.

The heating element holder further includes a supporting neck which protrudes out of the second surface of the support platform. The neck includes an axial bore therein and a transverse bore extending through the neck. The transverse bore is positioned on the neck so as to intersect with the axial bore. In the preferred embodiment, the neck has a substantially uniform cross-section along its length.

In addition to the neck, the heating element holder includes a plurality of buttress members connecting between the second surface of the support platform and the uniform exterior of the neck. The buttress members supply structural support to the neck.

Also, the heating element standoff comprises a metallic anchoring rod having a hooked end, a straight end, and a transverse bore therein. The transverse bore is positioned so as to be proximal to said straight end.

In one embodiment of the present invention, a ceramic spacer is included to adapt the standoff to a particular furnace wall configuration. The spacer includes a bore extending through its length. The bore is dimensioned to receive the neck therethrough.

One object of the present invention is to provide a high temperature heating element standoff fabricated substantially from ceramic materials.

Another object of the present invention is to provide a high temperature heating element standoff fabricated with as few parts as possible.

Another object of the present invention is to provide a high temperature heating element standoff of a design which makes changing of heating elements easy.

Other objects and advantages of the present invention will become apparent to those skilled in the art from the following detailed description read in conjunction with the attached drawings and claims appended hereto.

DESCRIPTION OF THE DRAWINGS

FIG. 1 is an exploded side view of the heating element standoff of the present invention;

FIG. 2 is a top plan view of the heating element holder illustrating the buttress members and neck having a bore therein for receiving the metallic anchoring rod;

FIG. 3 is a cross sectional top view of the cylindrical ceramic spacer;

FIG. 4 is a front elevational view of the heating element standoff as attached to a furnace wall, with a heating element retaining clip shown next to the standoff; ready for installation;

FIG. 5 is a cross sectional front elevation view of the heating element support platform of the heating element holder, taken along the plane 5—5 in FIG. 6; illustrating how the heating element is held in place by the heating element retaining clip;

FIG. 6 is side elevation view illustrating the heating element attached to the heating element standoff and the attachment of the heating element standoff to the furnace wall having insulation thereon;

DETAILED DESCRIPTION OF THE PRESENT INVENTION

Figure 7:
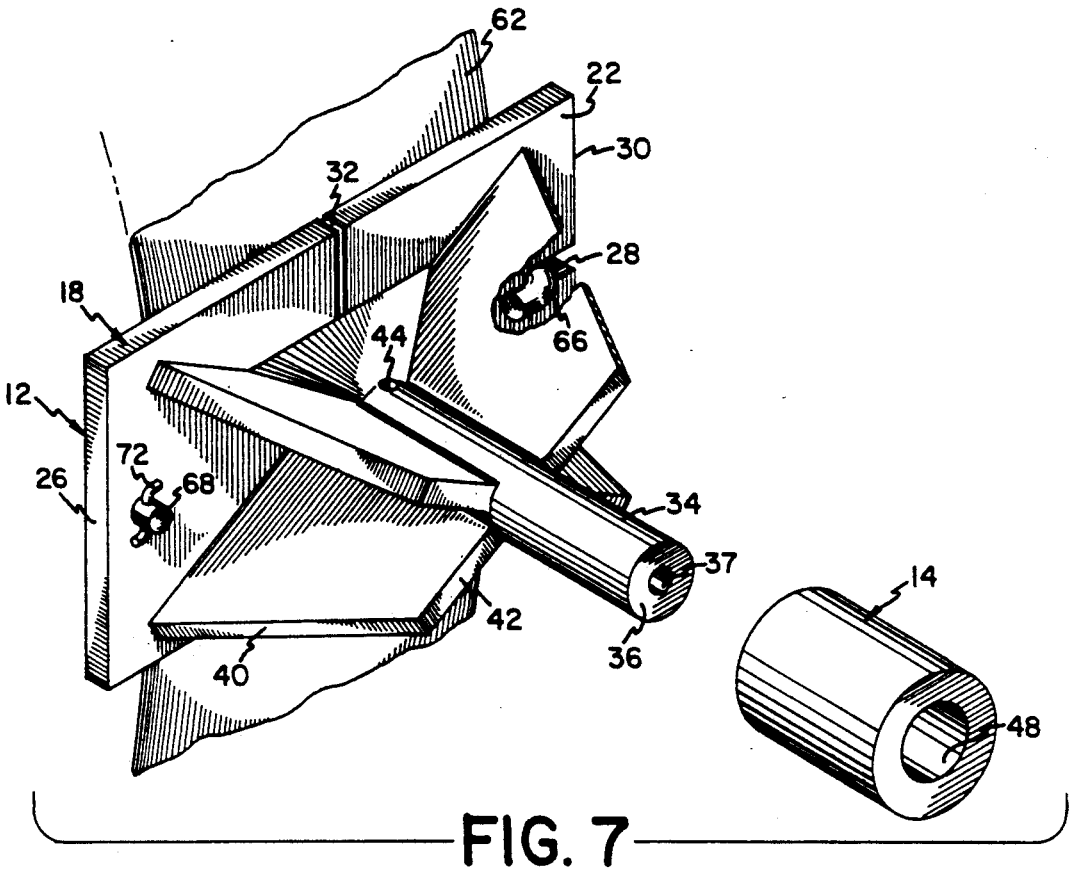
FIG. 7 is a perspective view of the heating element standoff of the present invention having the anchoring rod completely removed and the ceramic spacer lifted off of the heating element holder so as to show the heating element holder attached to a portion of a heating element.

FIG. 1 illustrates an exploded view of the components of the heating element standoff 10 of the present invention. The heating element standoff 10 shown therein comprises a ceramic heating element holder 12, an optional ceramic spacer 14 and an anchoring rod 16. The holder 12 and the ceramic spacer 14 are molded from Mul 6 TM, a proprietary ceramic material manufactured by Ceramco, Inc. of Center Conway, N.H. The Mul 6 TM ceramic is an alumina silicate that contains no more than 70 weight percent $Al_2O_3$. The Mul 6 TM ceramic has been fired at a temperature of 1400° to 1600° C. so as to achieve a relative density not exceeding 75 percent. The Mul 6 TM ceramic material is desirable for use in the present invention because the ceramic material has high dielectric properties and is machinable using ordinary well known machining techniques. In addition to the machinability and high dielectric properties, the porosity of the Mul 6 TM ceramic material helps reduce metalization of the standoff and prevents the alloying of the heater element to the standoff.

Referring to FIGS. 1 and 2, the holder 12 includes a heating element support platform 18 for securing a heating element 62 (FIGS. 5 and 7) to the heating element standoff 10. In the preferred embodiment, the heating element support platform 18 has a generally rectangular shape, and a first heating element engaging surface 20 and second surface 22. The first surface 20 is generally planar. The first and second surfaces 20 and 22 are substantially parallel and thereby define the thickness of the support platform 18. As will be appreciated by those skilled in the art, the shape of the first and second surface can be altered without deviating from the spirit of the present invention. In the preferred embodiment, an aperture 24 is placed at a first end 26 of the support platform 18 and a notch 28 is placed at a second end 30. The aperture 24 and notch 28 are arranged to receive a heating element retaining clip 64 (FIGS. 6 and 7). The clip 64 is used for retaining the heating element 62 adjacent to the first surface 20 of the support platform 18 of the heating element holder 12. The aperture 24 and notch 28 permit the use of retaining clip material having different coefficients of thermal expansion than the ceramic support platform. Thus, the aperture 24 and notch 28 help to prevent stress cracks from developing in the support platform 18 during heating and cooling cycles.

Also, to help prevent cracks from developing in the support platform 18 due to thermal stress resulting from heating and cooling cycles, the support platform 18 includes a pair of slits 32 extending through its thickness. In the preferred embodiment, the slits 32 are located at approximately the midpoint along the length of the platform 18 from the first end 26 to the second end 30. Each slit extends inward a predetermined distance which is generally less than one-half of the width of the support platform 18.

In addition to the heating element support platform 18, the heating element holder 12 also includes a neck 34 having a terminal end 36 and a platform end 38. In the preferred embodiment the neck 34 has a substantially circular cross-section. The neck 34 also includes an axial bore 37 beginning at the terminal end 36 and stopping adjacent to the platform end 38. The platform end 38 of the neck 34 is attached to the second surface 22 of the support platform 18. The neck 34 generally extends outwardly, away from the second surface 22 toward the adjacent furnace wall, and is positioned so as to have a substantially perpendicular orientation with respect to the first surface 20 of the support platform 18. It will be appreciated by those skilled in the art that the orientation of the neck 34 with respect to the first surface 20 of the heating element support platform 18 may be altered to suit the needs of the particular application and configuration of the hot zone of a vacuum furnace. Also, in the preferred embodiment of the present invention, the lower half of the neck 34 is supported by four identical buttress members 40 which are arranged in an X-like configuration. The buttress members 40 provide structural support for the neck 34. The buttress members 40 are attached to the second surface 22 of the support platform 18 and the neck 34. Each of the buttress members 40 generally extends outward from said second surface 22 towards the terminal end 36 of the neck 34 in an inclined manner. Each of the buttress members 40 includes a top surface 42 which is substantially parallel to the first surface 20 of the support platform 18. As will be seen below, the parallel top surface 42 provides a surface for seating the heating element holder against adjacent insulation 59 to a furnace wall (FIG. 8) or against the ceramic spacer 14 (FIGS. 4 and 6). It will be appreciated by those skilled in the art that a greater or lesser number of buttress members 40 may be used for structural support of the neck 34.

In addition to the axial bore 37 extending substantially along the length of the neck 34, the lower part of the neck also has a transverse bore 44 extending therethrough. In the preferred embodiment, the transverse bore 44 is positioned proximal to the platform end 38 of the neck and intersects the neck's axial bore 37. This positioning permits a first retaining pin 60 (FIG. 7) to be passed through the axial bore 37 of the neck 34 so as to engage and retain the anchoring rod 16. As will be appreciated by those skilled in the art, the transverse bore 44 may be placed in other locations and at other angular orientations without deviating from the spirit of the invention as long as any selected position will allow alignment with a transverse bore 54 in the anchoring rod 16 (FIG. 1).

Figure 8:
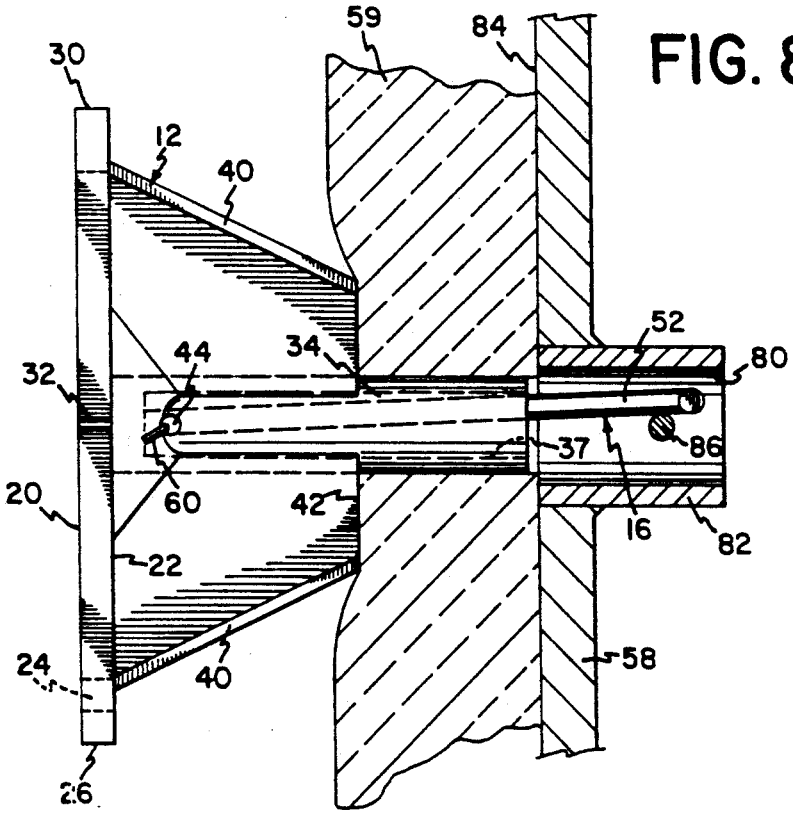
FIG. 8 is a front elevational view of the heating element standoff just prior to being attached a furnace wall having insulation thereon.

Referring now to FIGS. 4, 6 and 8, it can be seen that the standoff 10 can be used with or without the ceramic spacer 14. Use of the spacer 14 depends upon the specific configuration of the furnace wall 58 and any insulating material 59 (FIGS. 6 and 8) used in conjunction therewith. For example, in FIG. 4, a ceramic spacer is used to provide support and set the standoff 10 a predetermined distance away from a wall 58 having no insulation. In FIG. 6, a spacer 14 is used to set the standoff 10 a predetermined distance away from a wall 58 having insulation 59 adjacent thereto. In FIG. 8, no spacer is used to set the standoff 10 a predetermined distance from the wall 58.

FIGS. 3, 4, 6 and 7 illustrate the ceramic spacer 14 having a cylindrical shape. The spacer 14 shown therein has an axial bore 48 therethrough. The inside diameter of the bore 48 is selected to be slightly larger than the outside diameter of the neck 34 of the heating element holder 12 so as to allow placement of the spacer 14 over the neck 34 of the heating element holder 12. The height of the ceramic spacer 14 is selected to be slightly greater than the distance from the terminal end 36 of the neck 34 to the parallel top surfaces 42 of each buttress. It will be appreciated by those skilled in the art that the external surfaces of the spacer 14 may take any shape necessary for application of the standoff 10 to a specific furnace wall 58 and insulation 59 configuration without deviating from the spirit of the invention.

Referring back to FIG. 1, the metallic anchoring rod 16 includes a straight end 50 and a hooked end 52. The rod 16 provides a means for attaching the heating element holder 12 and optional ceramic spacer 14 to the furnace walls 58 (FIGS. 4 and 6). In the preferred embodiment, the anchoring rod 16 is fabricated from molybdenum. The transverse bore 54 is located near the straight end 50. The diameter of the rod 16 is selected to be slightly less than the inside diameter of the axial bore 37 in the neck 34 of the heating element holder 12 to allow passage of the rod 16 in the axial bore 37.

The anchoring rod 16 is attached to the heating element holder 12 by inserting the straight end 50 of the rod 16 into the axial bore 37 of the neck 34. A first metallic retaining pin 60 is inserted through both transverse bores 44 and 54 so as to secure the anchoring rod 16 to the heating element holder 12. In the preferred embodiment, the first metallic retaining pin 60 is fabricated from molybdenum. The standoff 10 is now ready for attachment to the furnace wall 58.

Although FIGS. 6 and 8 illustrate embodiments of the present invention with and without the spacer 14, the two figures illustrate the ease of attachment of the standoff 10 of the present invention to a furnace wall 58. The hooked end 52 of the rod 16 is placed into the bore 80 of a short pipe-like member 82, previously welded to the interior of the furnace wall 58. The pipe-like member 82 may be welded to the continuous furnace wall 58, or in a through aperture in wall 58. In either case, member 82 has a transverse pin 86 mounted therein. The hooked end 52 of the anchoring rod 16 is pushed into the opening 80 with a substantially parallel orientation with respect to the pin 86 (FIG. 8) so that the hooked end 52 extends past the transverse pin 86. Once past the pin 86, the standoff 10 is rotated approximately 90° with respect to the pin 86 so that the hooked end 52 engages the pin 86 (FIG. 6). Removal of the standoff 10 is accomplished by reversing the steps of installation.

After the heating element standoff 10 has been attached to the furnace wall 58, a heating element 62 may be attached to the standoff 10 by a metallic retaining clip 64. In the preferred embodiment, the clip 64 may be fabricated from a single piece of molybdenum and is bent so as to have a J-shaped end 66 and a L-shaped end 68. The L-shaped end 68 has a transverse bore 70 extending therethrough. Attachment of the heating element 62 to the standoff 10 is accomplished by placing the heating element 62 adjacent to the first surface 20 of the support platform 18, embracing heating element 62 between clip 64 and first surface 20, and placing the J-shaped end 66 of the retaining clip 64 around the notched portion 28 of the support platform 18 while the L-shaped end 68 is placed through the aperture 24 of the support platform 18 so that the transverse bore 70 is adjacent to the second surface 22 of the support platform 18. A second metallic retaining pin 72 is fitted through the transverse bore 70 of the L-shaped end 68 to hold the retaining clip 64 and heating element 62 to the standoff. In the preferred embodiment, the second metallic retaining pin 72 is fabricated from molybdenum.

Thus, what has been described is a high temperature ceramic heating element standoff for supporting a heating element in a vacuum furnace that has a longer life than a molybdenum standoff, is useful at a higher ultimate temperature, has better durability and lower cost of manufacture, and facilitates easy maintenance. While the preferred embodiment of the present invention has been described and illustrated, it is understood that the preferred embodiment is capable of variation, addition, omission, and modification without departing from the spirit and scope of the invention.

What is claimed is:

1. A heating element standoff for a vacuum heat treating furnace, said standoff comprising:

a ceramic heating element holder, said ceramic heating element holder including:

a heating element support platform, said support platform having a first surface and a second surface, wherein said first and second surfaces define the thickness of said platform, said support platform also having a notch and an aperture extending through said thickness of said platform, and said support platform also including at least one slit extending through said thickness and inward from an edge of said platform;

a neck protruding out of said second surface of said support platform, said neck including an axial bore therein and a transverse bore extending through said neck, said transverse bore positioned on said neck so as to intersect with said axial bore; and a plurality of buttress members, said buttress members connecting said second surface of said support platform to the exterior of said neck; and a metallic anchoring rod, said anchoring rod having a hooked end and a straight end, said rod having a transverse bore therein.

2. The heating element standoff of claim 1, wherein said ceramic is an alumina silicate containing no more than 70 weight percent $Al_2O_3$ and wherein said ceramic has been fired so as to achieve a relative density not exceeding 75 percent.

3. The heating element standoff of claim 1, wherein said neck has a substantially uniform circular cross-section along its length.

4. The heating element standoff of claim 1, wherein said standoff further comprises a ceramic spacer, said ceramic spacer having a bore therein dimensionally sized to receive said neck therethrough.

5. The heating element standoff of claim 1, wherein said anchoring rod is fabricated from molybdenum.

6. The heating element standoff of claim 1, further comprising a heating element retaining pin, said retaining pin having a J-shaped end and a L-shaped end, said L-shaped end having a transverse bore therethrough, said retaining pin having a predetermined length wherein said J-shaped end fits into said notch and about said thickness of said support surface of said heating element holder and said L-shaped end fits through said aperture in said support surface of said heating element holder so that said transverse bore is adjacent to said second surface.

* * * * *